United States Patent [19]

Julien et al.

[11] Patent Number: 5,046,426

[45] Date of Patent: Sep. 10, 1991

[54] SEQUENTIAL STRUCTURAL SEPARATION SYSTEM

[75] Inventors: Gerald J. Julien, Puyallup; Steven P. Robinson, Seattle, both of Wash.

[73] Assignee: The Boeing Company, Seattle, Wash.

[21] Appl. No.: 429,525

[22] Filed: Oct. 31, 1989

[51] Int. Cl.[5] ..... F42B 15/00

[52] U.S. Cl. ..... 102/377; 337/416

[58] Field of Search ..... 102/377; 169/42; 337/401, 402, 412, 416, 140

[56] References Cited

U.S. PATENT DOCUMENTS

| | | | |
|---|---|---|---|
| 3,500,276 | 3/1970 | Hingorany et al. | 337/416 |
| 3,863,570 | 2/1975 | Bixby | 102/377 |
| 4,055,829 | 10/1977 | Ruegsegger | 169/42 |
| 4,346,554 | 8/1982 | Glinecke | 169/42 |
| 4,597,632 | 7/1986 | Mallinson | 403/273 |

*Primary Examiner*—David H. Brown

*Attorney, Agent, or Firm*—Michael J. Neary

[57] ABSTRACT

A replacement for the conventional pyrotechnic separation device for large structural elements such as payload fairings on large missile systems is a sequence of nitinol wires or foil strips which, because of their high strength, will hold the structures together but, when heated electrically in sequence, will fuse in milliseconds to allow the structures to separate. The technique for fusing the wires sequentially is to provide wires of sequentially increasing lengths which will cause the shorter length, lower resistance wires to fuse first and the successively longer wires to fuse in sequence until all wires are fused.

10 Claims, 4 Drawing Sheets

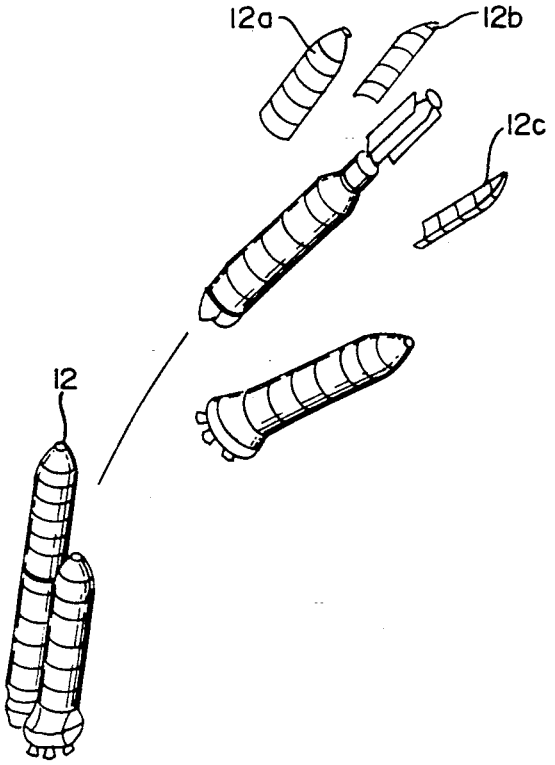
FIG. 1
FIG. 1A
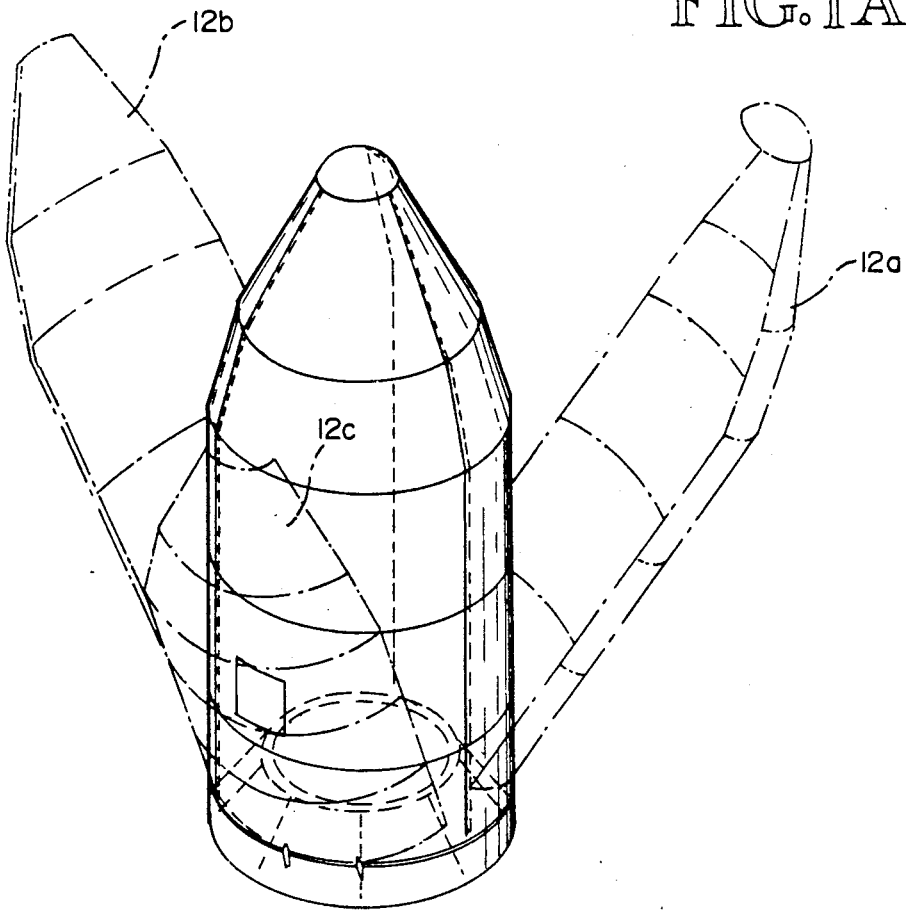

SEQUENTIAL STRUCTURAL SEPARATION SYSTEM

BACKGROUND OF THE INVENTION

This invention relates to a system for mechanically connecting two structural members together, and releasing the connection by electrical means which does not rely on pyrotechnics or other chemical reactions to achieve the separation.

The industry standard for separation of large structural members, (payload fairings, etc.) on large missile systems is ordnance primer cord actuators. Primer cord actuators are well proven with an excellent track record of reliability, but they suffer from certain practical aspects that make their use inconvenient and expensive. Since they are pyrotechnic in nature, there is a potential for inadvertent actuation which is a safety hazard that must be accounted for in use. Those safety hazards are accounted for by operational constraints enforced in the installation and checkout of the pyrotechnic devices, such as interruption of operation and clearing of the area when the ordinance devices are installed and checked out. Likewise, when the unused system is disassemblied, the same safety precautions must be taken to ensure that the pyrotechnic devices are not inadvertently initiated, with consequent injury to personnel in the area.

Pyrotechnic actuators also have certain other disadvantages in use. They often create high shock loads to nearby components, and they pose a contamination potential to delicate instruments and optical instruments. They require EMI shielding to prevent initiation of the ordnance by stray electrical signals. It is often necessary to provide a housing to contain stray mechanical fragments that are generated when the ordnance is initiated. Although the pyrotechnic devices are very reliable, it is difficult to perform an electrical test on the system after it is installed because of the danger of stray electrical signals initiating the pyrotechnic prematurely. Finally, the pyrotechnic devices are limited in temperature range and must be protected against corrosive environments and even water.

The maturity of current aerospace systems demands that the disadvantages mentioned above for pyrotechnic devices be reduced or eliminated. Cost must be reduced and the operational requirements for the installation and checkout and removal of the separation system must be simplified. Finally, the temperature range and environmental conditions in which the separation system must operate must be enlarged and the protections required for the separation system must be simplified or eliminated.

SUMMARY OF THE INVENTION

Accordingly, it is an object of the present invention to provide a separation system for releasable holding two mechanical members together using a serious of nitinol elements which function both as the structural connection between the members and also as the mechanism through which the release of the members is accomplished. It is another object of the invention to provide a releasable connection between structural members which is released electrically and is designed to operate with the smallest possible electrical power supply. It is yet another object of the invention to provide a releasable structural separation system that combines excellent corrosion resistance, efficient use of power supply, inexpensive control system, built in test, quick response time, small size, producability, maintainability and reliability, and provides all these advantages at low cost and operational simplicity.

These and other objects of the invention are obtained in a structural separation system having a plurality of nitinol elements connected mechanically and electrically in parallel between the two structural members to be connected by the system, and means for connecting an electrical power supply to the nitinol elements in such a manner that the elements fuse sequentially to release the two structural members.

DESCRIPTION OF THE DRAWINGS

The invention and its many attendant objects and advantages will become more clear upon reading the following detailed description of the preferred embodiment in conjunction with the following drawings, wherein:

FIG. 1 and FIG. 1*a* are isometric views of a missile showing a payload fairing which has just been released by the structural separation system of this invention;

DESCRIPTION OF THE PREFERRED EMBODIMENT

Figure 2:
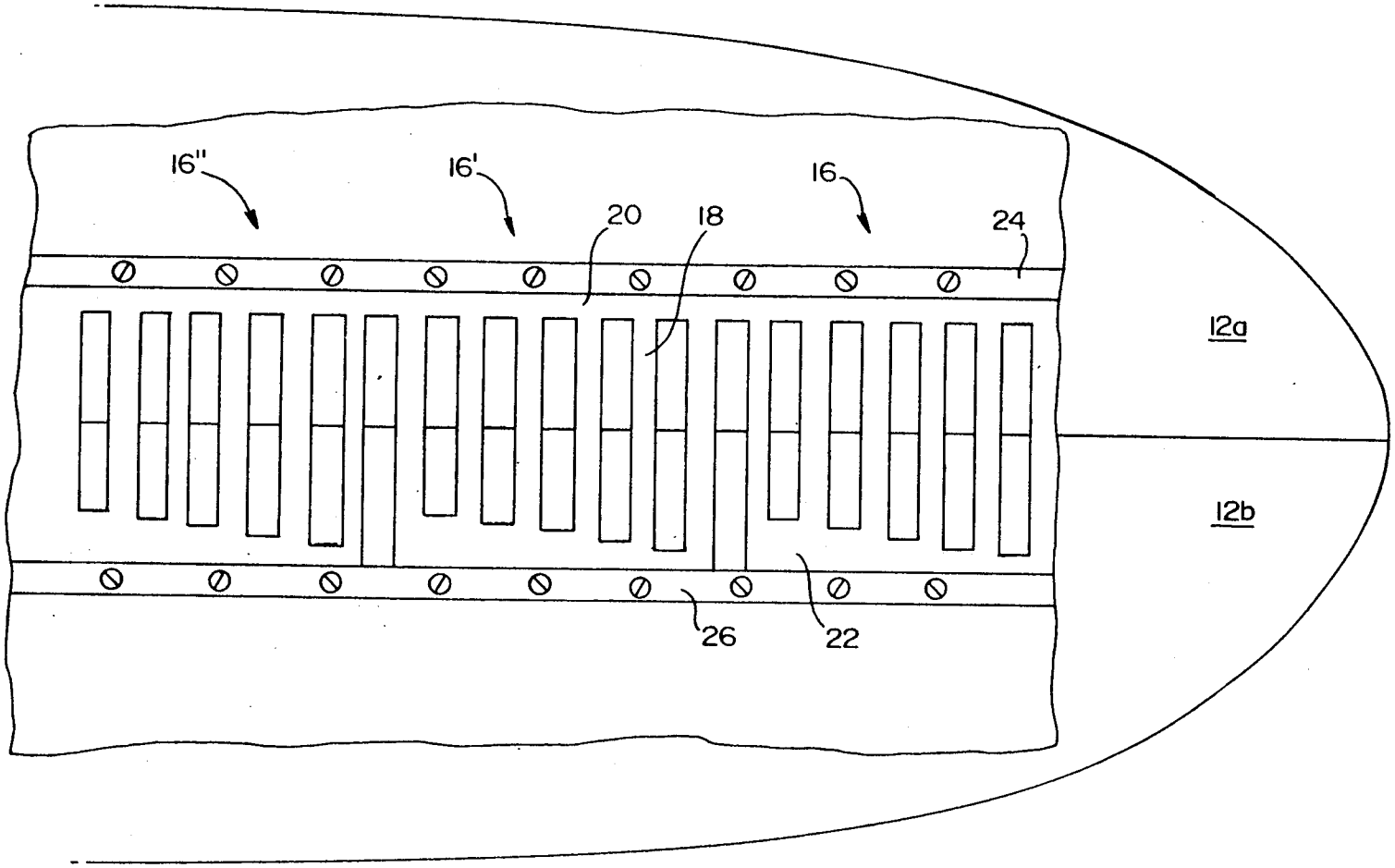
FIG. 2 is an elevation of a portion of the fairing as shown in FIG. 1 and shows a portion of the separation system holding the fairing sections together.

Referring now to the drawings where like reference characters identify identical or corresponding parts and more particularly to FIG. 1 thereof, a missile 10 is shown having a fairing 12 within which a payload 14 is carried by the missile. The payload 14 is deployed from the missile 10 when the fairing 12 is separated into three longitudinal "clam shell" sections and ejected from the missile, as shown in the second stage sequence of FIG. 1. The separation of the fairing sections is shown more clearly in FIG. 1*a*.

FIG. 2 shows a portion of two sections of the fairing 12 at one of the separation planes secured together by the separation system of this invention. The separation system is fashioned from a ribbon of nitinol foil having EDM cutouts to produce a series of modules 16, each of which has a series of six nitinol strips 18 of increasing lengths extending from a terminal strip 20 toward a corresponding terminal strip 22. The two terminal strips 20 and 22 are mechanically secured and electrically insulated by attachment plates 24 and 26 to structure within the missile to hold the fairing 12 sections together during flight and until the separation system is actuated, using the electrical control system shown in FIG. 6 and discussed in detail below.

Nitinol is a stoichoimetric mixture of nickel and titanium that was developed as a high strength, corrosion resistant alloy. It is non-magnetic, has a high electrical resistivity of about 80 microohm-centimeters, has an extremely high ultimate tensile strength of in its unannealed form of as much as 250 KSI and, in its austenitic state of 120 KSI, a yield tensile strength in its austenitic state of 60 KSI, and a Young's modulus in the austenitic state of 12 MSI. It has excellent corrosion resistance and a high melting temperature in the region of 1300° C. The high resistivity and high tensil strength of unannealed or austenitic nitinol make it an excellant material for a fusable mechanical connection, since a high load carrying capaciry can be provided in a nitinol element of snall enough cross-section to keep the resistance high.

A multiple module system show in FIG. 2, with each module consisting of six strips of 10 mil thick nitinol foil about ⅛ inch wide will carry a load of about 750 lbs for each module. This is more than adequate for most fairing connection applications, but if necessary the nitinol foil thickness or strip width can be increased to provide the necessary load carrying capacity.

Figure 3:
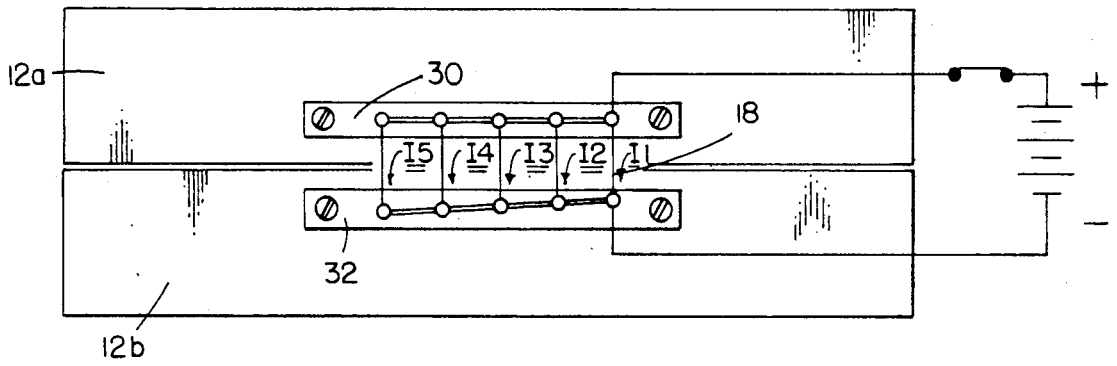
FIG. 3 is a diagram showing the electrical and mechanical arrangement of a second embodiment of the invention.

FIG. 3 shows a schematic of a second embodiment of the separation system shown in FIG. 2. It includes a terminal block 30 connected to the fairing section 12*a* and a terminal block 32 connected to structure within the fairing section 12*b*. A series of nitinol wires 18 are mechanically fastened between the terminal block 30 and the terminal block 32 to mechanically connect the two fairing sections 12*a* and 12*b* together.

Figure 4:
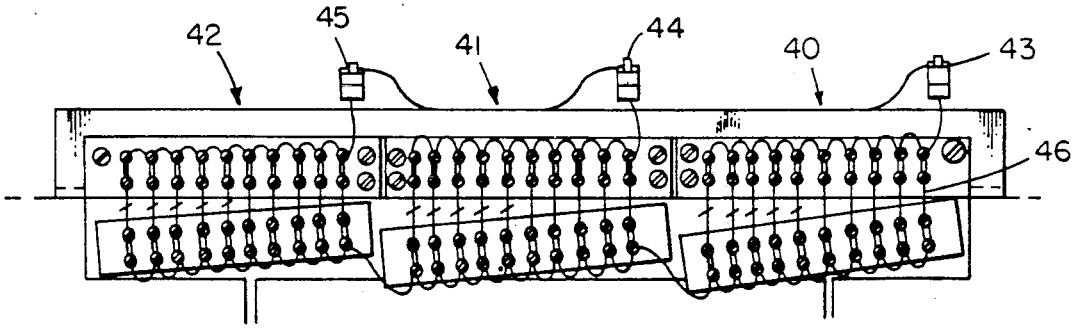
FIG. 4 is a diagram of a third embodiment of the invention in which the module of FIG. 3 is duplicated three times and connected to operate the modules in sequence.

In the event that a load carrying capacity greater than that provided by the embodiment of FIG. 3 is desired, the module shown in FIG. 3 can be staged with other similar modules as shown in FIG. 4 to multiply the load carrying compacity to any desired magnitude. The modules 40, 41 and 42 are connected in series as shown in FIG. 4 with a silicon controlled rectifier (SCR) or power transistor 43 in the circuit between the modules so that the power is applied initially only to the first module 40. When the last of the wires in the module 40 fuses, the power is transferred to the second module 41. The nitinol wires 46 in the second module 41 fuse sequentially in the same manner as in the embodiment of FIG. 3, and then the circuit is completed to apply power to the third module 42, to fuse its wires sequentially. The entire separation sequence for a multiple module separation system as shown in FIG. 2, can occur, for example, in less than 3–5 seconds, depending on the number of modules and the gage of the foil. It can also be designed to occur faster than that by initiating the modules in such a way that the loads on the fairing, such as inertial or aerodynamic loads, can assist in severing the nitinol elements holding the fairing sections together as they start to peel open.

Figure 5:
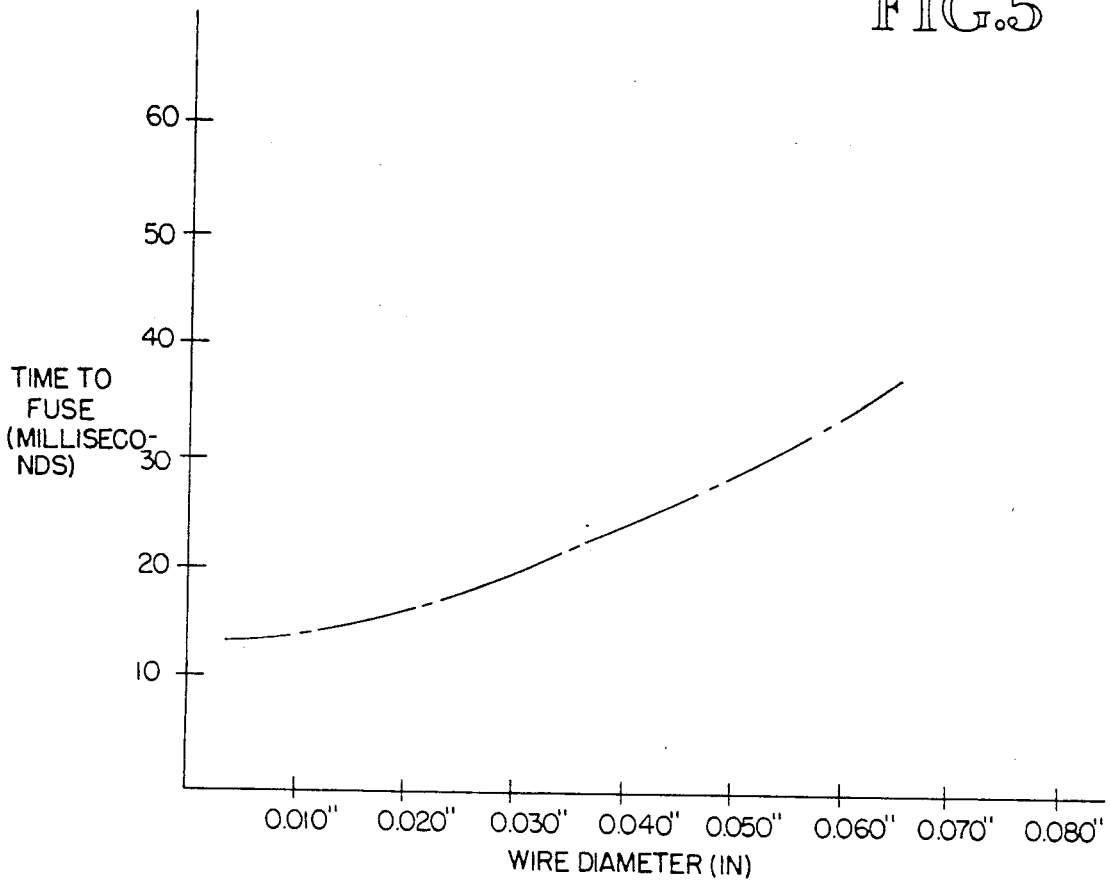
FIG. 5 is a graph showing the time in milliseconds to fuse a single element of nitinol actuated by a twenty-eight volt battery.

As shown in FIG. 5, the times to electrically fuse nitinol wire is on the order of 10–40 milliseconds, depending on the wire diameter. In a three module system shown in FIG. 4, the current from the source of electrical power such as a battery when first connected to the electrical circuit, passes through all of the ten wires of the first module 16, but because the first wire is the shortest it has the smallest resistance and so it will get the largest proportion of the current passing through the module. When the first wire fuses, the second wire will have the lowest resistance of the set and will receive the largest amount of current of any of the wires and it will quickly fuse also. During this time the other wires are also receiving some electrical current and are being preheated by the passage of current so that they will fuse more quickly then the first wires when their turn arrives. Thus the time for the entire system to operate from initiation to separation is less than half a second. Because of the preheating of the longer wires in each module, the time to fuse those wires is considerably shorter and so the actual time for the separation system, shown in FIG. 4, to release is on the order of 250 microseconds.

Figure 6:
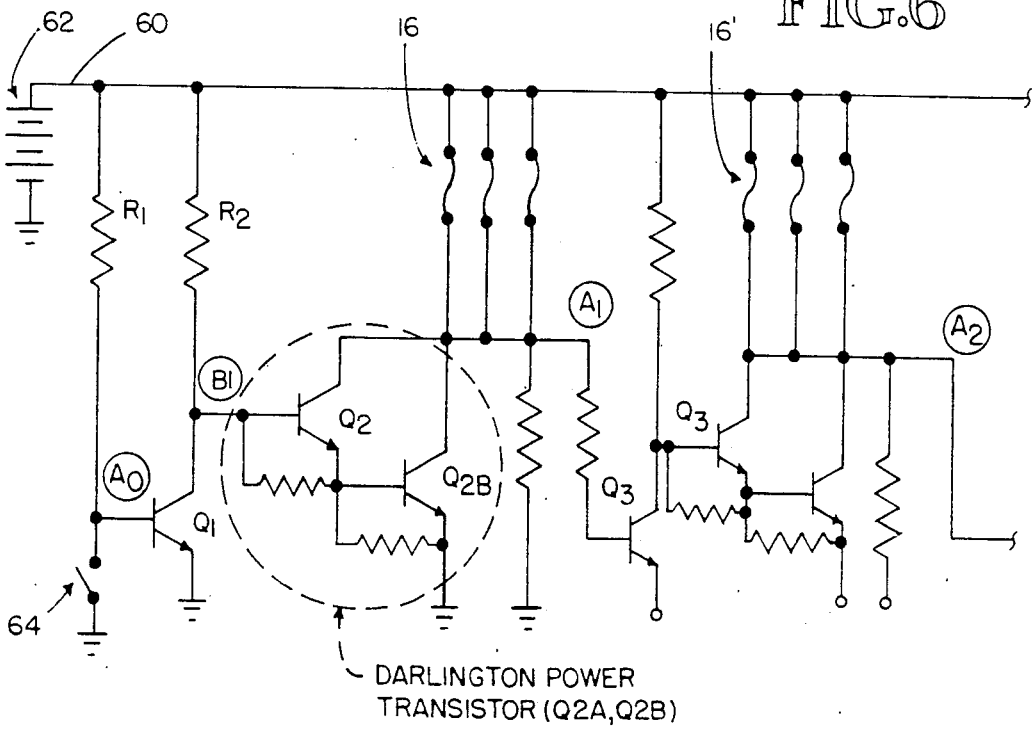
FIG. 6 is a circuit diagram of the embodiment of the invention shown in FIG. 2.

The circuit for the embodiments of FIGS. 2 and 4 is shown in FIG. 6. A power input line 60 from a battery 62 applies a voltage to a transistor Q1 when a relay 64 is open. When the relay 64 closes, the voltage at Ao drops and transistor Q1 turns off, thereby turning off the shunt to ground through R2 and Q1, so the voltage at $B_1$ climbs to near battery terminal voltage, turning on a power transistor Q2A and Q2B which opens a current path through the first module 16. The wires or strips in the first module fuse in sequence, as described previously, and the voltage of A1 drops to near zero, turning off transistor Q3 at the beginning of the control circuit for the next module 16. The control sequence is repeated for as many modules as are present.

We claim:

1. An electrically powered separation system for releasable holding two structural members together, comprising:

a first set of two terminal blocks, each having means thereon for mechanically fastening said blocks, one each to said members;

a plurality of nitinol elements mechanically connected between said terminal blocks for directly carrying the load holding said members together;

an electrical circuit for connecting said nitinol elements in parallel to a source of electrical power, including a conductor at each of said terminal blocks, one of which conductors is electrically connected to one end of each of said nitinol elements and the other of which conductors is electrically connected to the other end of each of said nitinol elements; and a switch for connecting said conductors across the source of electrical power;

said nitinol elements having different electrical resistances from each other, whereby a voltage applied across said conductors will cause current to flow through all of said elements, thereby raising the temperature of each one by an amount proportional to the square of the current therethrough, so said elements will fuse sequentially and disconnect said members from each other.

2. The system defined in claim 1, further comprising:

a second set of two terminal blocks and nitinol elements like said first set; means for connecting said second set of terminal blocks and nitinol wires into said electrical circuit in parallel with said first set after the last of said nitinol wires in said first set have fused.

3. The system defined in claim 1, wherein:

said nitinol elements are lengths of nitinol material, each having the same composition and gage, but having different lengths from each other, whereby the electrical resistances thereof are different from each other.

4. The system defined in claim 3, further comprising:

means on one of said terminal blocks to connect each of said nitinol wires to the other of said terminal blocks with equal distribution of said load between said wires.

5. An electrically operated releasable mechanical connector between two structural members, comprising:

a first terminal block adapted to be fastened to one structural members;

a second terminal block adapted to be fastened to the other structural member;

a first module having a first series of at least two nitinol elements mechanically and electrically connected in parallel between said terminal blocks, said nitinol elements having different electrical resistances from each other;

means for connecting said terminal blocks and said nitinol element across a source of electrical power;

whereby said nitinol elements will be heated by passage of electrical current through said elements and will fuse sequentially to release the mechanical connection between said members.

6. The connector defined in claim 5, further comprising:

a second module having a second series of at least two nitinol elements connected mechanically and electrically in parallel between said terminal blocks, said nitinol elements in said second set having different electrical resistances from each other.

7. The connector defined in claim 6, further comprising:

circuit means for connecting said first and second modules to said source of electrical power in sequence, so said modules are fused sequentially.

8. The connector defined in claim 7, wherein said circuit means comprises:

means for connecting said source of electrical power to across said first module until all elements in said first module are fused;

means for connecting said second module across said source of electrical power only after all of the elements in the first module have fused or severed.

9. An electrically operated releasable mechanical connector between two structural members, comprising:

a first terminal block adapted to be fastened to one structural members;

a second terminal block adapted to be fastened to the other structural member;

a first module having a nitinol element mechanically and electrically connected between said terminal blocks;

means for connecting said terminal blocks and said nitinol element across a source of electrical power;

whereby said nitinol element will be heated by passage of electrical current through said element and will fuse to release the mechanical connection between said members.

10. The connector defined in claim 9, wherein:

said nitinol element is a nitinol wire between 10 and 50 mils in diamenter.

* * * * *